United States Patent [19]

Miyawaki et al.

[11] Patent Number: 4,968,322

[45] Date of Patent: Nov. 6, 1990

[54] FUEL COMPOSITION AND FUEL ADDITIVE

[75] Inventors: Shintaro Miyawaki; Kiyomi Ishii; Mamoru Yamane, all of Toda, Japan

[73] Assignee: Nippon Mining Company, Limited, Tokyo, Japan

[21] Appl. No.: 334,457

[22] Filed: Apr. 7, 1989

[30] Foreign Application Priority Data

Apr. 7, 1988 [JP] Japan ..... 63-84029

[51] Int. Cl.[5] ..... C10L 1/30

[52] U.S. Cl. ..... 44/364; 534/16

[58] Field of Search ..... 44/68, 57; 534/16

[56] References Cited

U.S. PATENT DOCUMENTS

| | | | |
|---|---|---|---|
| 2,151,432 | 3/1939 | Lyons et al. | 44/68 |
| 2,737,932 | 3/1956 | Thomas | 44/68 |
| 4,251,233 | 2/1981 | Sievers et al. | 44/68 |
| 4,264,335 | 4/1981 | Bello et al. | 44/68 |
| 4,462,810 | 7/1984 | Jessup et al. | 44/68 |
| 4,522,631 | 6/1985 | Mourao et al. | 44/68 |
| 4,568,357 | 2/1986 | Simon | 44/68 |
| 4,775,389 | 10/1988 | Sung et al. | 44/68 |

FOREIGN PATENT DOCUMENTS

| | | | |
|---|---|---|---|
| 3245882 | 6/1984 | Fed. Rep. of Germany | 44/68 |

*Primary Examiner*—Margaret B. Medley

*Attorney, Agent, or Firm*—Oblon, Spivak, McClelland, Maier & Neustadt

[57] ABSTRACT

Disclosed herein are a fuel composition comprising a fuel oil added with at least two kinds of soaps selected from cerium, neodymium and lanthanum soaps and a fuel additive comprising an organic solution that contains at least two kinds of soaps selected from cerium, neodymium and lanthanum soaps.

4 Claims, No Drawings

FUEL COMPOSITION AND FUEL ADDITIVE

BACKGROUND OF THE INVENTION

1. Field of the Invention

This invention relates to a fuel composition, particularly to a fuel composition comprising a heavy oil-based fuel including heavy oil, coal slurry or COM and an additive for such a fuel.

2. Description of the Prior Art

Heavy oil-based fuels such as heavy oil, coal slurry and COM contain considerable amounts of carbon residue and moreover their ignition speeds are low. Therefore, their combustion is unstable and evolves a lot of unburned carbon or soot. It is hence necessary for such a fuel to use excess air at a high level, leading to reduction of the combustion efficiency. With this disadvantage in view, it has been attempted to add an combustion promoter to the fuel so as to suppress the evolution of soot, etc. even when the fuel is burnt with a low level of excess air. As the combustion promoter, there have been proposed fine particles of hydroxides or oxides of divalent to tetravalent metals which have adsorbed naphthenic acid, etc. (Japanese Patent Laid-Open No. 152794/1986) and iron oxide particulates comprising not less than 80% of the particulates with sizes of 1 $\mu$m and smaller (Japanese patent Laid-Open No. 106992/1987) by way of example.

However, these fuel additives are solid and therefore do not mix with the fuel so intimately. Moreover, the additives may precipitate if it takes a long period of time from their addition to the use of the fuel. Further, these additives are required in relatively large amounts to exhibit their effects, thereby rendering the addition operation complicated and giving adverse effects on the efficiency of dust collectors.

On the other hand, it has been disclosed that a basic and oil-soluble cerium soap with not more than 3 equivalents of acid to the cerium atom is useful as a combustion additive (Japanese Patent Laid/Open No. 12907/1978). However, there has been a strong desire to develope combustion additives with further improved combustion promotive effects.

SUMMARY OF THE INVENTION

The present inventors have made intensive investigations into fuel additives with a view to solving the aforementioned problems and improving combustion speed further. As a result, it has surprisingly been found that the addition of at least two kinds of soaps selected from cerium soap, neodymium soap and lanthanum soap in combination causes the effect of promoting combustion speed to increase more markedly than the single addition of cerium soap.

The invention has been completed on the basis of this discovery. An object of the invention is to provide a fuel additive, which is soil soluble, does not settle during long-term preservation, is effective even with the addition of its small amount and exhibits enhanced effect of promoting combustion speed, and a fuel composition having the additive mixed, and thereby to permit efficient and stable combustion of heavy oil-based fuels.

Additional objects and advantages of the invention will be set forth in part in the description which follows, and in part will be obvious from the description, or may be learned by practice of the invention.

To achieve the objects and in accordance with the purpose of the invention, as embodied and broadly described herein, the invention provides a fuel composition comprising a fuel oil added with at least two kinds of soaps selected from cerium, neodymium and lanthanum soaps and a fuel additive comprising an organic solution that contains at least two kinds of soaps selected from cerium, neodymium and lanthanum soaps.

Being formed by adding at least two kinds of soaps selected from cerium, neodymium and lanthanum soaps to a fuel oil, the fuel composition of the invention offers such noticable effects that it is oil soluble, does not settle during long-term preservation, is effective even with the addition of its small amount, and gives enhanced effects of promoting combustion speed.

DESCRIPTION OF THE PREFERRED EMBODIMENT:

Reference will now be made in detail to the present preferred embodiment of the invention.

The cerium, neodymium or lanthanum soap can be prepared, by the direct reaction of fine particles of each of these metals with a heated organic acid such as naphthenic acid, octylic acid, stearic acid or palmitic acid, by the reaction of the hydroxide of cerium, neodymium or lanthanum, or a salt thereof, with the organic acid, or by its precipitation from an aqueous solution of a salt of the rare earth element with the help of an alkaline soap of the organic acid.

It is preferable for the soap of the invention to contain the rare earth element and the organic acid in nearly equivalent amounts or to contain the organic acid in slight excess of the equivalent value, due to the better solubility to fuel oils.

In the invention, the cerium, neodymium and lanthanum soaps may be prepared separately and mixed properly with each other upon their addition to fuel oils. Alternatively, the soaps may be prepared from their raw materials having been mixed beforehand, and used directly for the addition to fuel oils.

The soap employs cerium, neodymium or lanthanum as described above. However, it may also contain soaps of other rare earth elements such as samarium, praseodymium, promethiumn and yttrium, in addition. Therefore, soaps formed by using hydroxides or salts of a so-called mixed rare earth or concentrated rare earth in the form of mixed rare earth elements prior to its separation into individual elements are available at low prices and hence are particularly preferred.

In the invention, it is especially preferable to use the cerium, neodymium and lanthanum soaps in such a way that principal two of the soaps added fall within the range of 3:7 to 7:3 in terms of their rare earth element ratio. By controlling the element ratio within this range, synergetic effects of the two soaps can be significantly increased.

The amount of the soaps added relative to a fuel oil may be determined suitably in the range of 10–1,000 ppm in terms of their rare earth elements, namely, cerium, neodymium and lanthanum. Any amounts less than 10 ppm do not produce marked effects of addition, while amounts in excess of 1,000 ppm do not improve the combustion speed in proportion to the amount of addition. Therefore, any amounts outside the range are not economical and hence not preferred.

On the other hand, in order to prepare the fuel additive, it is advisable to mix the soaps with an organic solvent so as to allow the concentration of their rare earth elements to fall within the range of 1–7% by weight. If the soaps are mixed in an amount less than 1% by weight, the amount of the resulting additive to be added to a fuel will be increased, thus rendering the transportation and addition operations complicated. If the soaps are mixed in more than 7% by weight, the resulting additive may possess lowered fluidity, thus making difficult the addition operation or the control of the amount of addition. Thus, any amounts outside the range are not preferred.

Organic solvents used for the fuel additive may include aromatic solvents such as benzene, toluene and xylene and petroleum-base mixed solvents such as white spirit, mineral terpene, kerosine and gas oil. These solvents are generally used as extractants or diluents in the process of soap production. Consequently, when the concentration of rare earth elements is controlled by a solvent in the above-described range in the production of soaps, the resultant solvent may be used directly as a fuel additive.

The fuel additive may be added to a fuel oil by controlling the concentration of rare earth elements in the resulting fuel oil at the same level as in the preparation of the aforementioned fuel composition.

The invention will now be illustrated in detail by reference to the following nonlimitative examples.

EXAMPLES 1-4 AND COMPARATIVE EXAMPLES 1-8

In each Example or Comparative Example, an octylate soap of rare earth elements with compositions given in Table 1 was added to No. 6 fuel oil (ASTM D-396) having a specific gravity of 0.9580, a pour point of 12.5° C., a Conradson carbon residue content of 9.08% by weight and a sulfur content of 1.44% by weight in an amount of 25 ppm as the sum of the rare earth elements based on the resulting fuel composition. Then, the combustion speed of the carbonaceous solid was measured.

Using a differential thermogravimetric analyser (Shimadzu Corp. Model EGC-30), a DTA thermogram was obtained by raising the temperature to 400°-600° C. at a heating rate of 85° C./min and thereafter maintaining the temperature at the same level until the combustion is complete, while allowing air to flow through the combustion zone at a rate of 30 ml/min. The combustion speed was calculated for the combustion part of the carbonaceous solid in the later phase of the combustion according to the formula of Shibata, et al. [Shibata, et al., Transaction of Japan Society of Mechanical Engineers, 34, 260, p 769 (Apr., 1968)] given below:

$$\frac{1}{\sigma m}\ \frac{dm}{dt} = \frac{1}{\tau\sigma} \ln \frac{m_1}{m_2}$$

wherein $\sigma$: specific surface area [$m^2$/kg]
m: weight of sample [kg]
$m_1$: initial weight [kg]
$m_2$: half-life weight [kg]
t: time [sec]
$\tau$: half-life [sec].

In the above formula, $\sigma$ was $175\times10^3$ $m^2$/kg, $m_1/m_2$ was 2, and the half-life $\tau$ (sec) was determined from the differential thermogram.

The results are shown in Table 1.

TABLE 1

| | Composition of rare earth element in a soap (% by weight) | Combustion speed ($\times10^{-8}$ kg/$m^2$ sec) |
|---|---|---|
| Example 1 | Ce 50, Nd 50 | 3.77 |
| Example 2 | Ce 50, La 50 | 3.77 |
| Example 3 | La 50, Nd 50 | 3.00 |
| Example 4 | Ce 48, Nd 21, La 23, Sm 3, Pr 5 | 3.30 |
| Comp Ex 1 | Ce 100 | 2.28 |
| Comp Ex 2 | La 100 | 1.64 |
| Comp Ex 3 | Nd 100 | 1.60 |
| Comp Ex 4 | Y 100 | 1.63 |
| Comp Ex 5 | Ce 50, Y 50 | 2.10 |
| Comp Ex 6 | La 50, Y 50 | 1.80 |
| Comp Ex 7 | Nd 50, Y 50 | 1.73 |
| Comp Ex 8 | not added | 1.36 |

As is clear from the above-described results, the combustion speed was increased substantially when the fuel oil was added with at least two soaps selected from cerium, neodymium and lanthanum soaps.

COMPARATIVE EXAMPLE 9

The combustion speed was measured in the same manner by using iron soap in place of the aforementioned rare earth soaps. The combustion speed was $1.6\times10^{-8}$ kg/$m^2$ sec when the iron soap was added to No. 6 fuel oil (ASTM D-396) in an amount of 25 ppm as iron content. When the amount was increased to 1,000 ppm, the combustion speed attained $2.3\times10^{-8}$ kg/$m^2$ sec.

EXAMPLE 5

A salt of octylic acid and a mixture of rare earth elements (Ce, La, Nd and Pr) was added to asphalt oil having a specific gravity of 1.0286 (15° C./4° C.) and a residual carbon, sufur, calcium and iron contents of 15.5%, 4.05%, 18 ppm and 70 ppm by weight respectively to obtain a fuel composition. In the fuel composition, concentrations of Ce, La, Nd and Pr were 12.7 ppm, 6.1 ppm, 4.8 ppm and 1.5 ppm respectively in terms of metals.

The composition was burnt in a broiler (Kawasaki Heavy Industries, Ltd., Model F-125E) having a steam generating capacity of 125 ton/hr and equipped with two stages of three front-type burners.

Dust in the exhaust gas from the boiler was collected with an electrostatic precipitator. Amount of the dust thus collected was 0.5 g/kg-fuel.

COMPARATIVE EXAMPLE 10

Example 5 was repeated except that the fuel composition did not contain cerium octylate. The amount of the collected dust was 1.0 g/kg-fuel.

EXAMPLE 6

The following materials were blended:

| | |
|---|---|
| an aqueous solution containing 16.9% by weight of sodium octylate | 3406 kg |
| an aqueous solution of rare earth chlorides containing 2.83% by weight of rare earth metals | 2701 kg |
| light oil | 2306 kg |

The mixture was stirred and reached at 75° C., kept still, and separated into a water phase and an oil phase. The oil phase was washed with hot water to obtaine a fuel additive containing 17.5% by weight of rare earth octylates (4.3% by weight of rare earth metals). The resulting fuel additive weighed 2880 kg.

We claim:

1. A fuel composition comprising a fuel oil containing at least two kinds of soaps selected from cerium, neodymium and lanthanum soaps, the total amount of the soaps added being in the range of 10–1,000 ppm by weight in terms of the rare earth elements, and the principal two soaps added having a ratio of 3:7–7:3 in terms of the rare earth elements.

2. The fuel composition as claimed in claim 1 wherein the soaps are prepared from hydroxides or salts of a mixed rare earth or concentrated rare earth without being separated into individual elements.

3. A fuel additive comprising an organic solution containing at least two kinds of soaps selected from cerium, neodymium and lanthanum soaps within the range of 1–7% by weight in terms of the rare earth elements in the total content, the principal two soaps having a ratio of 3:7 to 7:3 in terms of the rare elements, and the organic solvent used in the organic solution being selected from aromatic solvents such as benzene, toluene and xylene and petroleum base mixed solvents such as white spirit, mineral terpene, kerosene and gas oil.

4. The fuel additive as claimed in claim 3 wherein the soaps are prepared from hydroxides or salts of a mixed rare earth or concentrated rare earth without being separated into individual elements.

* * * * *